United States Patent [19]

Hirabayashi et al.

[11] 4,386,838

[45] Jun. 7, 1983

[54] COMPONENT MOUNTING ARRANGEMENT FOR ELECTROSTATIC RECORDING APPARATUS

[75] Inventors: Tsugio Hirabayashi; Isao Ikemoto, both of Hachioji, Japan

[73] Assignee: Konishiroku Photo Industry Co., Ltd., Tokyo, Japan

[21] Appl. No.: 244,349

[22] Filed: Mar. 17, 1981

[30] Foreign Application Priority Data

Apr. 4, 1980 [JP] Japan ..... 55-44486

[51] Int. Cl.[3] ..... G03G 21/00

[52] U.S. Cl. ..... 355/3 DR; 355/133

[58] Field of Search ..... 355/3 DR, 3 R, 11, 3 DD, 355/8, 133

[56] References Cited

U.S. PATENT DOCUMENTS 3,883,240 5/1975 Ito et al. ..... 355/3 DD 4,286,861 9/1981 Matsumoto et al. ..... 355/3 DD

*Primary Examiner*—R. L. Moses

*Attorney, Agent, or Firm*—Jordan B. Bierman; Linda Bierman

[57] ABSTRACT

In an electrostatic recording apparatus means are provided for precisely mounting various components or processing units about the photosensitive drum. In particular, a subassembly detachably connected to the apparatus supports the drum and is provided with fixed supports to which the processing units such as the charging electrode, developing device, image transfer electrode, etc. are attached. The arrangement assures a precise spacing of the said units relative to the drum.

2 Claims, 5 Drawing Figures

COMPONENT MOUNTING ARRANGEMENT FOR ELECTROSTATIC RECORDING APPARATUS

BACKGROUND OF THE INVENTION

1. Field of the Invention:

The present invention relates to a recording apparatus including an electrophotographic copying machine having a unit which is capable of being detachably mounted to the apparatus, particularly to the structure of the unit or to the frames, and supporting components of the unit. On the unit, an electrostatic charge holding member such as photosensitive drum and at least one processing unit, for example, electric charging means for image formation are arranged.

The term "processing unit(s)" is to use herein for charging means mentioned above, developing means, image transfer means such as image transfer electrode and image transfer roller, separating means such as separation electrode, separation claw and buffer, and electrically neutralizing means such as neutralizing electrode and neutralizing lamp.

Generally in an electrostatic recording apparatus such as electrophotographic copying machine, it is necessary to arrange a plurality of processing units around the peripheral surface of the photosensitive drum to process an image, as is well known, and it is necessary to determine the exact position between said processing units and the surface of the photosensitive drum. Especially in case of using a medium or high speed copying machine, wherein a photosensitive drum having a narrow latitude is used, it is necessary to accurately set the correlative positive between the processing units and the photosensitive drum.

To date, in conventional electrophotographic copying machines, fixtures are provided on the frame of said machines to which a photosensitive drum is mounted, and the processing units are fixed upon said fixtures, or, as shown in FIG. 1, rails 2–7 span the machine frames A for supporting the various processing units, for example, electric charging means 8 comprising wire electrode, developing means 9, image transfer means 10, separation electrode 11, neutralizing electrode 12 and cleaning means 13, are insertedly fixed in said rails. Therefore in such a structure it is difficult to keep the relative position of said processing units to the position of the photosensitive drum 1 and adjustment of said relative positioning is made by way of inserting spacers or the like between the processing units and the fixtures or rails 2–7. Such adjustment processes account for a major proportion of the assembly process, so that the labor costs, etc for the adjustment process make the manufacturing costs comparatively high. In addition, the adjustments by inserting spacers or the like adversely affects the reproductive function of the processing units when reassembling them for maintenance, and is a bottle-neck in the maintenance procedure.

SUMMARY OF THE INVENTION

It is an object of the present invention to provide an electrostatic recording apparatus including an electrophotographic copying machine having a unit for mounting a photosensitive drum and at least one processing unit (means), for example, such as electric charging means, wherein the unit is detachably mounted to the apparatus, and processing unit(s) is arranged on the unit from outside of the drum toward the center of the drum.

A further object of the present invention is to provide an electrostatic recording apparatus having a unit which comprises two frames spaced from each other for mounting a photosensitive drum therebetween, and on which positioning surfaces (means) for regulating the position of the processing units to be used are formed or provided.

Another object of the present invention is to provide an electrostatic recording apparatus having a structure such that the correlation of exact measurements and positions of a photosensitive drum and each of processing units can easily be determined by simply fitting each of the processing units on the corresponding positioning surfaces.

According to the present invention, said objects can be accomplished, in an electrostatic recording apparatus arranged with a plurality of electrophotographic processing units around a photosensitive drum being mounted on a fixed section of the apparatus, wherein at least a pair of positioning surfaces are provided at the fixed sections (correspond to frames for mounting the drum), so as to strictly keep the radial distances from a point which the center of the photosensitive drum is positioned to each of the processing units respectively, and at least one of the processing units is butted and fixed onto the positioning surfaces.

The above and other objects, novel features and advantages of the invention will be more apparent from detailed description of the preferred embodiments thereof taken in conjunction with the accompanying drawings.

DETAILED DESCRIPTION OF THE PREFERRED EMBODIMENTS

Figure 1:
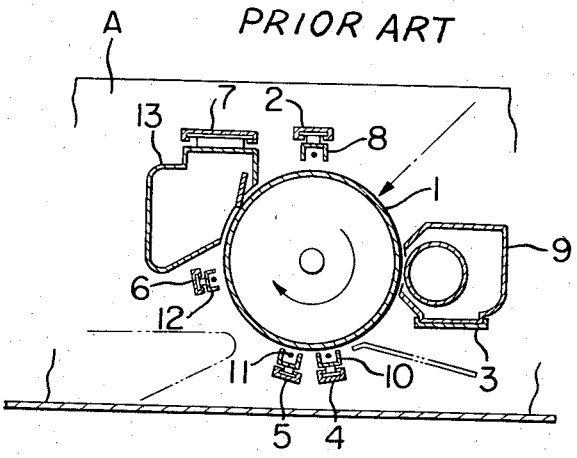
FIG. 1 PRIOR ART
FIG. 1 is a diagrammatic representation of a conventional electrophotographic copying machine.
Figure 2:
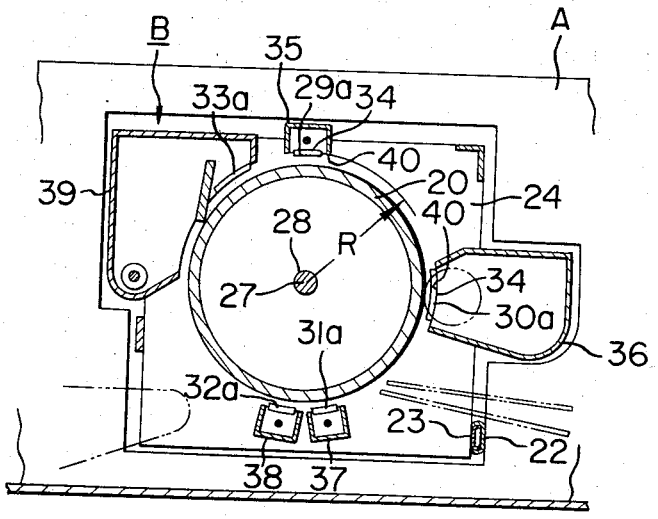
FIG. 2 is a cross-sectional view of an electrophotographic copying machine according to the first exemplary embodiment of the invention.
Figure 3:
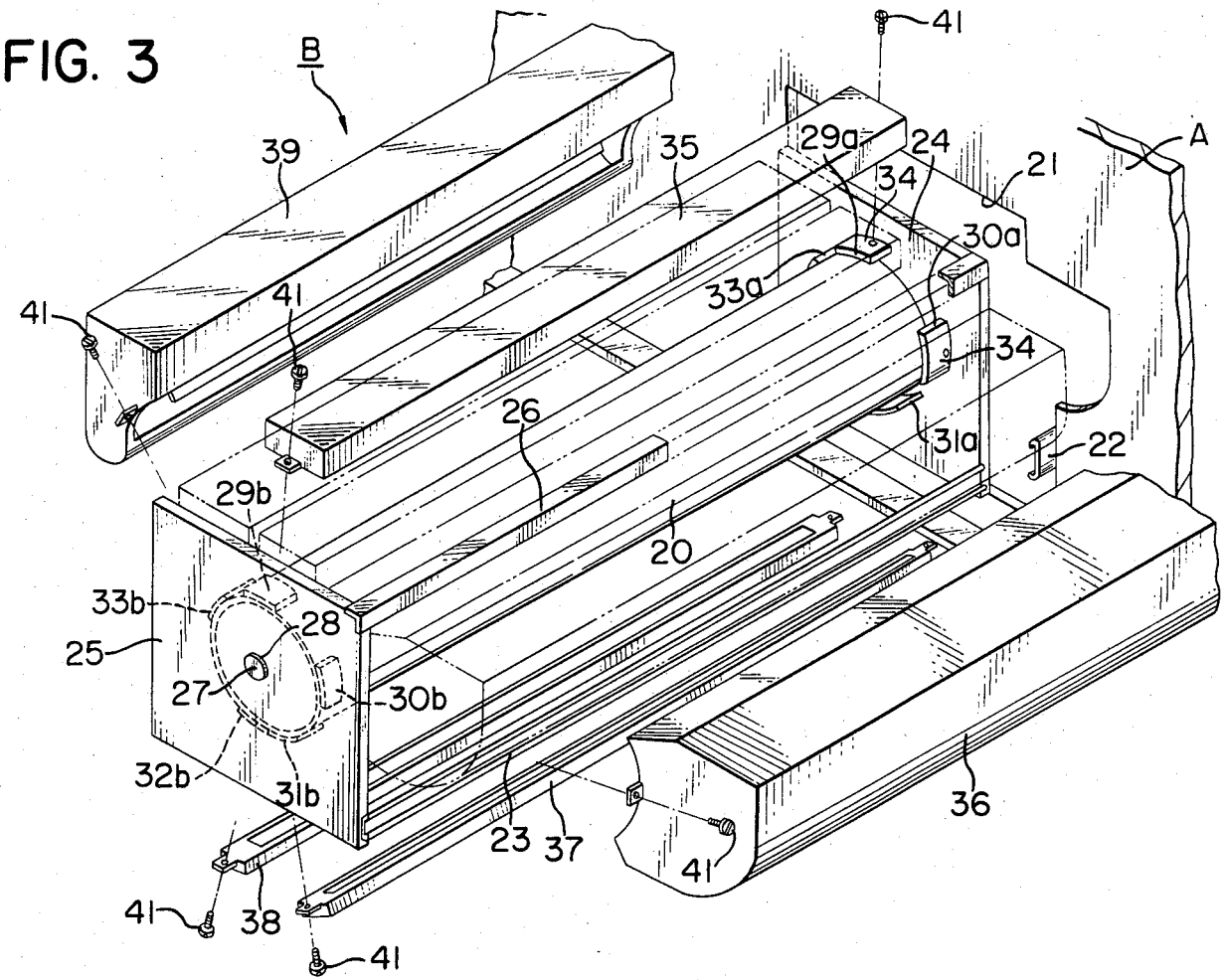
FIG. 3 is an enlarged exploded perspective view of said machine.

FIG. 2 and FIG. 3 illustrate the first exemplary embodiment of the invention, wherein, sub-assembly carrying a plurality of processing units (means) and a photosensitive drum 20 to be used therein can easily be attached to and detached from machine frame A. More specifically, on one side of machine frame A, a window 21 whose shape substantially corresponds to the cross-sectional shape of sub-assembly B, is cut through, and on one side of said window 21, a guide rail 22 is provided to horizontally span the distance between machine frames A. Sub-assembly B is guided along said guide rail 22, through a sliding rail 23 connected to end plates 24, 25 (called as frames as compared with the machine frames, hereinafter), and is attached to the inside of machine frame A through window 21 by suitable means.

It is preferable that a plurality of pairs of rails 22 and 23 are provided to prevent the clatter of the unit.

Sub-assembly B is formed from a pair of end plates 24 and 25 facing each other and precisely finished by the metal die casting for example, and the distance between said plates 24 and 25 is maintained by connecting means such as horizontal bar 26 and said sliding rail 23 both of which are spanned between them, thus sub-assembly B is constituted in the shape of a crate. The center of each of said plates 24 and 25 is provided with a center hole 28 to accept central axle 27 of the photosensitive drum 20. Also, inside said plates 24 and 25, a plurality of pairs of protrusions 29*a*, 29*b*, 30*a*, 30*b*, 31*a*, 31*b*, 32*a*, 32*b*, 33*a* and 33*b* surround said center hole 28 and protrude parallel inwardly in the direction of photosensitive drum 20. Furthermore, the other surfaces of said protrusions 29*a*–33*b* are precisely processed so as to maintain a predetermined distance R (see FIG. 2) from said center hole 28 and for positioning mounting surfaces 34 (referred to as positioning means, sometimes). In this connection, when the processing units, i.e., charging electrode 35, developing device 36, image transfer electrode 37, separation electrode 38, and cleaning device 39,, are mounted on said protrusions 29*a*–33*b*, and if datum levels 40 having been formed on said processing units are butted onto the corresponding positioning surfaces 34 and then attached to them with screws 41 or the like, the relative positions of photosensitive drum 20 and each processing unit would be determined without any adjustment.

Needless to say the processing means are attached to the corresponding positioning means by operation from outside of the drum toward the center of the drum.

Figure 4:
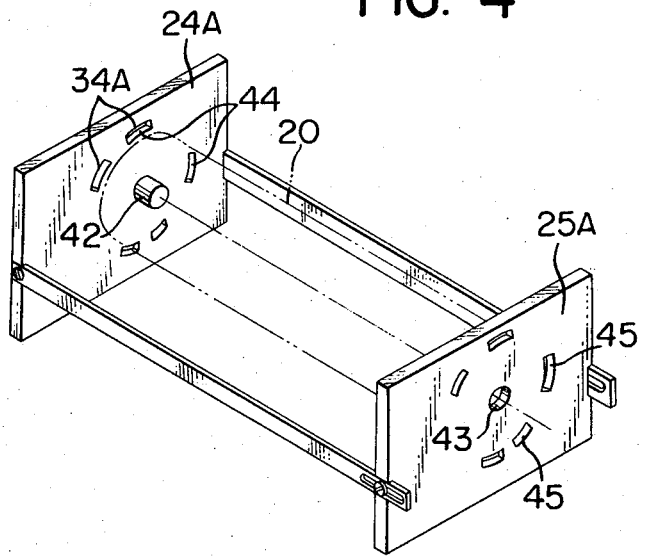
FIG. 4 is a principal perspective view of a second exemplary embodiment of the invention.

FIG. 4 illustrates the second exemplary embodiment of the invention characterized in the feature that photosensitive drum 20 is mounted between end plates 24A and 25A by using a spindle 42 and center hole 43 which are provided on the frames, and that positioning surfaces 34A comprise the circular arc surfaces of fixing holes 44 and 45 perforated around spindle 42 and center hole 43 respectively with same distance from the center of the axle or the hole. The mounting of each processing unit onto said end plates 24A and 25A, can be done if protrusions are formed so that the surface thereof butting onto positioning surface 34A can be taken as a datum level, and the other surface thereof can be made as an inclined surface, and said protrusions are simply inserted into fixing holes 44 and 45.

Figure 5:
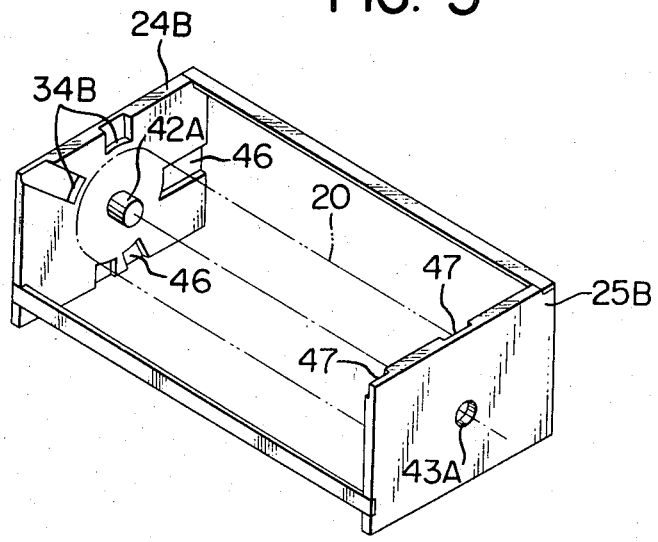
FIG. 5 is a perspective view of a machine illustrating a third exemplary embodiment of the invention.

These holes mentioned above may be formed with cutting the frames from the edges thereof to the each positioning surface, Further, FIG. 5 is the third exemplary embodiment of the invention, wherein similar to the second exemplary embodiment, spindle 42A and center hole 43A are used for supporting photosensitive drum 20. On the inside surfaces of opposed end plates 24B and 25B, hollows 46 and 47 are provided to accept opposite ends of each processing means and each of said processing units is butted and fixed onto positioning surfaces 34B provided on the edges of said hollows 46 and 47.

If the drum has axles at both ends thereof, the support for the axle in the end plates 24A, 24B as shown by FIGS. 4 and 5 should be hollows.

In each of the exemplary embodiments illustrated above, there are given the examples in which the photosensitive drum and processing units are mounted on frames on supports separately from the machine frames. However, it can also be possible to embody a structure in which the center axle or center hole for mounting a photosensitive drum is processed directly onto the machine frames themselves, and teat the positioning surfaces are processed on the machine frames so as to keep the exact distance from the central point of said center axle or center hole.

As is obvious from the above description, according to the present invention, a center axle or center hole is processed to mount a photosensitive drum onto the frames and each processing unit is butted directly onto the corresponding correct positioning surface so as to keep the distance exactly from the center of said axle or hole, therefore the relative positions of the circumferential surface of the photosensitive drum and each of the processing units are primarily determined. Therefore, if the datum level of each processing unit and the positions of the structural elements such as the wire electrode in the charging unit were adjusted prior to the assembling of each processing unit and the photosensitive drum, there would not be any necessity of an adjustment process in the total assembly. Also in the reassembly for the maintenance, the relative positions can be correctly obtained by only butting the datum level of each processing unit onto the positioning surface, and thus, there are good advantages such as the security of satisfactory reproductivity, and a shortening of time required for maintenance.

The present invention can be used for recording apparatus wherein an electrophotographic processing unit including a photosensitive drum and other reproducing means such as optical fiber tube (OFT) for image formation are provided.

What is claimed is:

1. In an electrostatic recording apparatus having a rotatably mounted photosensitive drum and a plurality of processing units arranged about said drum, the improvement comprising a sub-assembly comprising a pair of end frames supporting the drum between them and connecting means holding said end frames apart, means detachably attaching said unitary structure to said apparatus, and a plurality of pairs of positioning means extending inwardly from each end frame supporting said processing units about said drum.

2. In an electrostatic recording apparatus having a main frame, a rotatably mounted photosensitive drum and one or more processing units arranged about said drum, the improvement comprising a crate-like frame consisting of a pair of end plates spaced apart and rigidly interconnected by horizontal connecting means, means rotatably supporting said drum between said end plates, means formed at each end plate precisely spaced a predetermined radial distance from the surface of the drum to support a processing unit at its optimum operable distance from said drum, said last means comprising a plurality of pairs of inwardly projecting extensions formed on the inside of each of said plates, and in which the outer surface of each such extension is precisely radially spaced from the drum a predetermined distance applicable to the processing unit it is adapted to support, means on each processing unit cooperating with said supporting means attaching the same to the outer surface of such extensions to mount the processing unit entirely between the end plates of the crate-like frame, and means detachably connecting such crate-like frame to said main frame.

* * * * *